US007124505B2

(12) United States Patent
Friesen et al.

(10) Patent No.: US 7,124,505 B2
(45) Date of Patent: Oct. 24, 2006

(54) BACKSHELL ASSEMBLY

(75) Inventors: Duane Friesen, Edmonton (CA); Val Mandrusov, Santa Clara, CA (US)

(73) Assignee: Silicon Graphics, Inc., Mountain View, CA (US)

( * ) Notice: Subject to any disclaimer, the term of this patent is extended or adjusted under 35 U.S.C. 154(b) by 0 days.

(21) Appl. No.: 10/205,877

(22) Filed: Jul. 24, 2002

(65) Prior Publication Data

US 2002/0182925 A1 Dec. 5, 2002

Related U.S. Application Data

(62) Division of application No. 09/730,077, filed on Dec. 5, 2000, now abandoned.

(60) Provisional application No. 60/215,472, filed on Jun. 30, 2000.

(51) Int. Cl.
*H01R 43/00* (2006.01)

(52) U.S. Cl. ..... 29/869; 29/825; 29/857; 29/868; 439/246

(58) Field of Classification Search ..... 29/876, 29/884, 827, 825, 874, 868, 877, 842, 854, 29/857, 869; 439/246
See application file for complete search history.

(56) References Cited

U.S. PATENT DOCUMENTS 2,853,690 A 9/1958 Madison
3,094,364 A 6/1963 Lingg ..... 439/247
3,111,355 A 11/1963 Samburoff et al.
4,090,768 A * 5/1978 Tregoning
4,162,816 A 7/1979 Malsot
4,548,455 A 10/1985 Ezure
4,580,862 A 4/1986 Johnson ..... 439/248
4,684,192 A 8/1987 Long et al. ..... 439/374
4,688,868 A * 8/1987 Noyes
4,786,260 A * 11/1988 Spaulding
4,789,351 A 12/1988 Fisher, Jr. et al.
5,092,774 A 3/1992 Milan
5,317,105 A * 5/1994 Weber
5,411,415 A 5/1995 Embo et al. ..... 439/610
5,647,758 A 7/1997 Ichikawa et al. ..... 439/362
5,975,953 A * 11/1999 Peterson
6,017,245 A 1/2000 Karir ..... 439/610
6,435,903 B1 8/2002 Nelson
6,588,937 B1 7/2003 Imai et al. ..... 385/53
6,592,387 B1 7/2003 Komenda et al. ..... 439/247

* cited by examiner

*Primary Examiner*—Carl J. Arbes
(74) *Attorney, Agent, or Firm*—Schwegman, Lundberg, Woessner & Kluth, P.A.

(57) ABSTRACT

A cable connector backshell assembly for high frequency applications requiring reduced electromagnetic emissions. Aspects include providing sufficient physical spacing and electrical isolation between the signal conductors and the housing to meet EMI standards for HIPPI-6400 connector assemblies. One embodiment includes spring preloading of the electrical connector. One embodiment includes a longitudinally floating connector.

21 Claims, 10 Drawing Sheets

BACKSHELL ASSEMBLY

RELATED APPLICATIONS

This application is a Divisional Application of U.S. patent application Ser. No. 09/730,077, filed Dec. 5, 2000, now abandoned, entitled BACKSHELL ASSEMBLY, which claims priority to U.S. Provisional Patent Application No. 60/215,472, filed Jun. 30, 2000.

TECHNICAL FIELD OF THE INVENTION

The present invention relates generally to the field of electrical connectors, and, in particular, to a connector backshell assembly suitable for applications prone to high levels of radiated electromagnetic emissions.

BACKGROUND

Electromagnetic interference (EMI) affects the performance of electrical circuits. Reduction of sensitivity to EMI, as well as the reduction of radiated levels of EMI, is an important consideration in the design of electrical circuits and devices. With increasing power levels and frequency, spurious radiation emissions also rises. Conversely, circuits operating with reduced power levels are particularly sensitive to undesirable radiation.

Designers often rely on gaskets and other shielding measures to reduce EMI transmissions. An area of particular interest concerns adequate shielding for high density connectors. Density refers to the number of electrical connections in a given area of a connector. A typical high density connector has 100 pins in the space having dimensions of approximately 38 mm by 10 mm, or an area of 3.8 $cm^2$. An example of an application calling for such a connector is the High Performance Parallel Interface-6400 (HIPPI-6400) protocol. HIPPI-6400 relates to high frequency, digital data transmissions at 6400 Mbit/s of data per direction. Common mode currents on outer shields due to capacitive coupling and poor bonding of shielding components can result in the failure to meet applicable EMI compliance standards.

High density connectors are also prone to undesirable capacitive coupling between the connector housing and individual pins within the connector. As capacitive coupling rises, so to do levels of EMI radiation.

One proposed solution to ameliorate EMI radiation involves gasketing between the connector nose and connector housing while reducing capacitive coupling with increased spacing. Proper assembly technique requires that the connector pins and receivers are filly mated at a time when the gasket material, positioned between the nose of the connector backshell and the housing for the electronic circuitry, is sufficiently compressed. In this state, the proper electrical connection is established at the connector halves and the gasket has sufficiently low impedance with the housing such that an effective EMI seal is established. However, manufacturing tolerances often frustrate achievement of this result. In some cases, the connector pins will have reached the bottom of the connector receiver before the gasket material is sufficiently compressed, resulting in a higher impedance coupling to the housing and undesirable EMI leakage. If the connector jackscrews are tightened beyond a point where the connector assembly is fully mated, then it is likely that the connector, standoffs, or connector jackscrews will be damaged.

For the reasons stated above, and for other reasons stated below which will become apparent to those skilled in the art upon reading and understanding the present specification, there is a need in the art for a connector assembly to address the problem of undesirable EMI transmissions without adversely effecting the electrical connection.

SUMMARY

The above mentioned problems associated with connector assemblies for applications prone to interference from high levels of radiated electromagnetic emissions, and other problems, are addressed by the present invention and will be understood by reading and studying the following specification.

In particular, an illustrative embodiment of the present invention includes a connector apparatus comprising an electrical connector, an insulative member encasing the electrical connector, an electrically conductive housing, and a plurality of clamping screws. The electrical connector has a cable end and a coupling end wherein the cable end is adapted for receiving a conductive cable and the coupling end is adapted for mating with a matching connector. The insulative member surrounds the electrical connector between the cable end and the coupling end. The housing is adapted to receive the insulative member and includes a nose end and a cable orifice wherein the nose end is proximate to the coupling end and the cable orifice is proximate to the cable end. The housing includes a bottom and a lid. The clamping screws engage the housing and are threadably coupled with the matching connector.

In one embodiment, the insulative member displaces the conductive cable relative to the housing. In one embodiment, the insulative member is rigidly captivated by the electrically conductive housing. In one embodiment, the electrically conductive housing includes a way aligned substantially on an axis defined by the nose end and the cable orifice wherein the insulative member couples with the way. In one embodiment, the connector apparatus comprises a spring coupled to the housing and adapted to urge movement of the connector in a direction along the axis. In one embodiment, the insulative member is plastic.

In one embodiment, the present subject matter provides a backshell comprising an electrical connecter, a housing, a clamping screw and a spring. The electrical connecter includes sides, a mating end and a cable end and the connector includes an insulated shell substantially surrounding the sides. The mating end is adapted to mate with a matching connector in an electrical circuit housing and the cable end adapted to receive an electrical conductor of a cable. The housing has a longitudinal axis and includes a mating face near a first end of the axis, a cable orifice near a second end of the axis, two side walls aligned substantially parallel to the longitudinal axis, a bottom and a lid defining an interior of the housing. The mating end is proximate the mating face and the cable end is proximate the cable orifice. The housing includes a way for receiving the electrical connector and is adapted for permitting relative movement of the electrical connector and the housing along the longitudinal axis. The housing includes a clamping surface having a fixed position relative to the mating face. The housing includes a bore aligned substantially parallel with the longitudinal axis. The housing is electrically conductive. The clamping screw has a thread portion, a shoulder and a head. The clamping screw passes through the bore and the thread portion is proximate the mating face and the head is proximate the cable orifice. The shoulder is adapted for exerting pressure on the clamping surface. The spring exerts a force urging the electrical connector in the direction of the mating face. Engagement of the clamping screw with a threaded standoff associated with the matching connector causes the mating face to be drawn towards the electrical circuit housing and the spring urges the electrical connector to engage the matching connector.

In one embodiment, the spring is threaded on the clamping screw. In one embodiment, the spring is a tension spring. In one embodiment, the spring exerts a force on the clamping surface.

In one embodiment, the housing includes a clamping surface having a fixed position relative to the mating face and the housing includes a bore aligned substantially parallel with the longitudinal axis. The housing is electrically conductive. Furthermore, the embodiment includes a clamping screw having a thread portion, a shoulder and a head with the clamping screw passing through the bore and the thread portion is proximate the mating end and the head is proximate the cable orifice. The shoulder is adapted for exerting pressure on the clamping surface. Furthermore, the embodiment includes a spring threaded on the clamping screw and exerting opposing forces on the clamping surface and the electrical connector. Engagement of the clamping screw with a threaded standoff associated with the matching connector causes the mating face to be drawn towards the electrical circuit housing and the spring urges the electrical connector to engage the matching connector.

In one embodiment, the way permits travel of the connector beyond the mating face. In one embodiment, the housing comprises a metal housing. In one embodiment, the electrical connector sides are metal.

In an alternative embodiment, the subject matter provides a connector apparatus comprising an electrical connecter, a metal housing and a clamping screw. The electrical connecter has sides, a mating end and a cable end and an insulated shell substantially surrounding the sides. The mating end is adapted to mate with a matching connector coupled to an electrical circuit housing and the cable end is adapted to receive an electrical conductor of a cable. The metal housing has a longitudinal axis and includes a mating face near a first end of the axis, a cable orifice near a second end of the axis, two side walls aligned substantially parallel to the longitudinal axis, a bottom and a removable lid defining an interior of the housing. The mating end is proximate the mating face and the cable end is proximate the cable orifice. The housing is adapted for receiving the electrical connector and includes a clamping surface. The clamping surface is proximate to one of the side walls and extending towards the interior space. The clamping surface has a bore aligned substantially parallel with the longitudinal axis. The clamping screw has a thread portion, a shoulder and a head. The clamping screw passes through the bore in the clamping surface and the thread portion is proximate the mating end and the head is proximate the cable orifice. The shoulder is adapted for exerting clamping pressure on the clamping surface. Engagement of the clamping screw with a threaded standoff associated with the matching connector causes the mating face to be drawn towards the electrical circuit housing.

In one embodiment, the removable lid is electrically conductive. In one embodiment, the removable lid includes a plurality of clearance holes and the metal housing includes a plurality of threaded holes aligned with the plurality of clearance holes and the removable lid is secured to the housing using threaded fasteners. In one embodiment, the mating face of the metal housing exerts pressure on the electrical circuit housing. In one embodiment, the insulated shell comprises a plastic housing adapted to receive the electrical connector.

In an alternative embodiment, the present subject matter provides a connector housing comprising a conductive receptacle, a clamping surface and a connector cavity. The conductive receptacle has an interior and an exterior, as well as a nose end and a terminating end aligned substantially along a longitudinal axis. The clamping surface is coupled to the receptacle and the clamping surface is adapted to oppose a force exerted on an axis aligned substantially parallel to the longitudinal axis. The connector cavity is on the interior of the receptacle and receives an electrical connector encased in an insulative jacket. The electrical connector is adapted for coupling to a cable and the cable is routed via the terminating end. The conductive receptacle is electrically isolated from the connector and the conductors of the cable.

In one embodiment, the receptacle includes a conductive metal. In one embodiment, the clamping surface is located within the interior of the receptacle.

In an alternative embodiment, the present subject matter provides a method of manufacturing a connector, with the method comprising providing a conductive housing, providing an electrical connector, providing an insulative jacket and providing a mechanical fastener. The conductive housing has a nose and a terminating end and includes an interior and an exterior. The electrical connector includes a plurality of conductive members and is encased in a conductive jacket. The insulative jacket surround s the conductive jacket of the electrical connector and the insulative jacket is rigidly secured to the electrical connector. The mechanical fastener enables coupling the housing to a matching connector.

In one embodiment, the method comprises assembling a cable to the electrical connector. In one embodiment, the method comprises coupling the connector with the housing. In one embodiment, the method comprises assembling a lid to the conductive housing.

DETAILED DESCRIPTION

The following detailed description refers to the accompanying drawings which form a part of the specification. The drawings show, and the detailed description describes, by way of illustration specific illustrative embodiments in which the invention may be practiced. These embodiments are described in sufficient detail to enable those skilled in the art to practice the invention. Other embodiments may be used and mechanical and electrical changes may be made without departing from the scope of the present invention. The following detailed description is, therefore, not to be taken in a limiting sense. Like reference numbers refer to similar items in all the figures.

In the following detailed description, the present system relates to the backshell assembly. The backshell assembly includes the connector, the cable end, and the housing in which the connector is encased. The connector of the backshell assembly mates with a matching connector affixed to an electronic circuit housing or circuit board. As used herein, references to the forward direction are understood to mean in a direction towards the matching connector. Consequently, to engage the electrical connector, the backshell assembly is moved in the forward direction. The rearward direction is understood to denote in a direction away from the matching connector. Consequently, to disengage the electrical connector, the backshell assembly is moved in the rearward direction.

In embodiments shown herein, the connector is marketed under the trademark MICROPAX®. MICROPAX® is a registered trademark of Berg Technology, Inc., One East First Street, Reno, Nev. 89501. The MICROPAX® connector includes a conductive shell and paddleboards for making connection to a cable as well as a matching connecter. One embodiment of the MICROPAX® connector meets the standards of HIPPI-6400. Other connectors, shells or components may also be utilized in the present system. The present system is suited for applications wherein EMI is possible. One typical application entails a high frequency connector having high density. It is understood, however, that the present system is not so limited, and may be used, for example, with low density connectors and in applications where EMI radiation is not a significant concern.

Figure 1A:
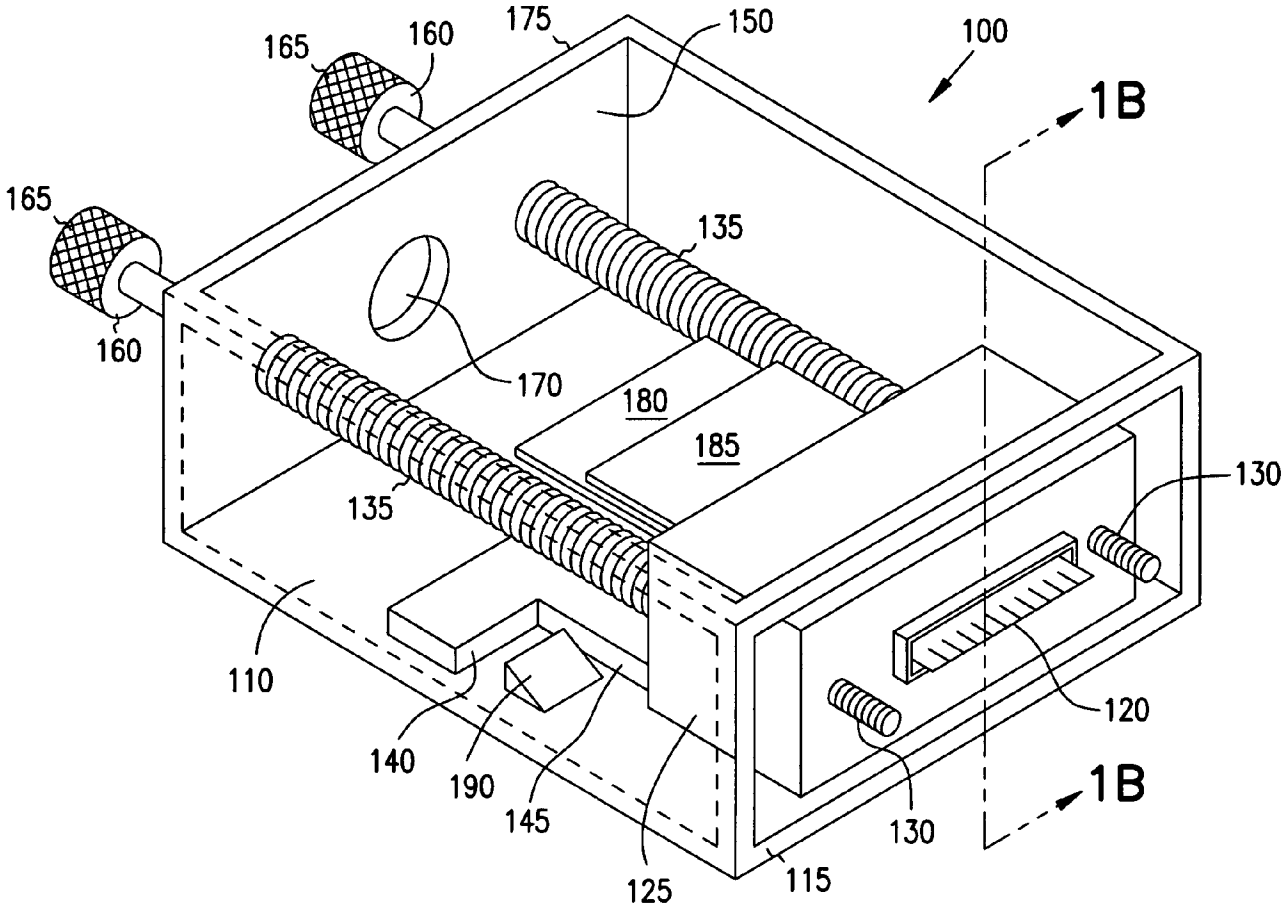
FIG. 1A illustrates an isometric view of one embodiment of the present system.

FIG. 1A depicts one embodiment of the present subject matter, backshell assembly 100, with the lid removed. Backshell assembly 100 includes housing 110. In one embodiment, housing 110 is fabricated of electrically conductive material, such as aluminum. Alternatively, housing 110 may be fabricated of insulative material having a conductive layer, in which case, the conductive layer may be internal, external or elsewhere relative to housing 110. Housing 110 has mating face 115 adapted for mating with a conductive circuit housing, or a conductive circuit housing with a conductive gasket. Housing 110 also has a back wall, the interior surface of which is designated as item 150 in FIG. 1, and the exterior surface of which is designated as item 175 in FIG. 1.

In the embodiment shown, assembly 100 also includes electrical connector 120. Electrical connector 120 may include a high density connector shell, such as a MICROPAX® connector. Connector 120 has forward end that mates with a matching connector assembly. Connector 120 also has a rearward, or cable, end. In one embodiment, the cable end of connector 120 accepts two paddleboards, 180 and 185. Paddleboards 180 and 185 are adapted for connecting to electrical conductors of a cable. For sake of clarity, the cable is not shown in the drawing. The cable may include multiple copper, aluminum, or other conductors. The cable may be soldered to paddleboards 180 and 185. The cable enters the backshell assembly via cable orifice 170, shown here in the back wall of the housing. The cable may enter the backshell assembly on another wall of the assembly.

In one embodiment, connector 120 is encircled with shell holder 125. Shell holder 125 is fabricated of insulative material. In one embodiment, shell holder 125 is plastic. In one embodiment, shell holder 125 is fabricated of DELRIN® or TEFLON®, both registered trademarks of E. I. DU PONT DE NEMOURS AND COMPANY, 1007 Market St., Wilmington, Del. Connector 120 is received in a cavity of shell holder 125 and, in the embodiment shown, paddleboards 180 and 185 extend in a direction opposite that of mating face 115. Paddleboards 180 and 185 provide a ground connection to maintain signal integrity pursuant to the standards of the HIPPI-6400 specification. Shell holder 125 provides physical spacing between the signal conductors of the cable and the connector relative to housing 110 sufficient to attenuate EMI radiation through housing 110. Shell holder 125 also provides electrical isolation between the signal conductors and the housing to meet EMI standards for HIPPI-6400 connector assemblies.

In one embodiment, shell holder 125 is coupled securely to shell holder base 145. In one embodiment, base 145 is in slidable contact with the interior surface of the bottom of housing 110. Base 145 is shaped to fit within the bottom of housing 110 and allow shell holder 125 to slide linearly within housing 110. In one embodiment, base 145 includes an ear 140 on each side. Each ear 140 is in contact with an interior side wall of housing 110. In one embodiment, mechanical stops provide limits to the forward and rearward movement of shell holder 125 within housing 110. In one embodiment, the rearward limit is established by the compressed length of spring 135. In one embodiment, the forward movement of shell holder 125 is limited by stop 190 securely attached to housing 110. Alternatively, the forward movement of shell holder 125 is limited by the spring in the relaxed position. In one embodiment, the forward and rearward limits of shell holder 125 are established by a slot in shell holder base 145. A pin, stud, or screw engaging the slot prevents movement of shell holder 125 beyond the forward and rearward limits. In the embodiment shown in the figure, stop 190 provides a mechanical limit to the forward travel of shell holder 125. In one embodiment, shell holder 125 travels on a longitudinal axis of housing 110 in a way. The way may include formed linear sections of housing 110 which are engaged by complementary elements of shell holder 125. In another embodiment, shell holder 125 is captivated by, and moves in, ways formed by structure within housing 110. Such structure may include the springs 135, clamping screws, or jackscrews, 230, the interior sidewalls of housing 110, or any other such structure.

In one embodiment, a pair of jackscrews extend forward alongside connector 120. Each jackscrew has a thread end 130, a head 165, and a shoulder 160 positioned between thread end 130 and head 165. In the embodiment shown, shoulder 160 is the underside of head 165. In one embodiment, shoulder 165 is a larger diameter portion adjacent to a smaller diameter portion. The threads on thread end 130 correspond with threads on a standoff associated with a matching connector coupled to an electronic circuit housing.

Proper mating of connector 120 with a matching connector entails establishing electrical connection as well as engaging the threads of the jackscrew with the threaded standoff.

In one embodiment, the jackscrews pass through the interior of housing 110. In one embodiment, the jackscrews are external to housing 110. In the embodiment shown, the jackscrews pass through the back wall of housing 110.

Springs 135 provide a force urging shell holder 125 in the forward direction. In one embodiment, spring 135 is a wound tension spring threaded on a jackscrew. In the embodiment shown, spring 135 is captivated by structural elements within housing 110. Structural elements may include counterbores, studs, raised portions or other means of captivating spring 135. In the embodiment shown, two jackscrews and two springs are depicted. The present system may include a single jackscrew or more than two jackscrews. In various embodiments, the present system includes a single spring or more than two springs. Preloading of spring 135 urges a low impedance connection of connector 120 with the matching connector.

Alternatively, rearward movement of the shell holder 125 may be limited by a threaded fastener engaging the threads of the jackscrew. For example, in an embodiment having two jackscrews, a threaded nut on each jackscrew may be used to captivate, and restrict the movement of, shell holder 125. Other means of limiting the rearward movement of shell holder 125 are also contemplated.

Figure 1B:
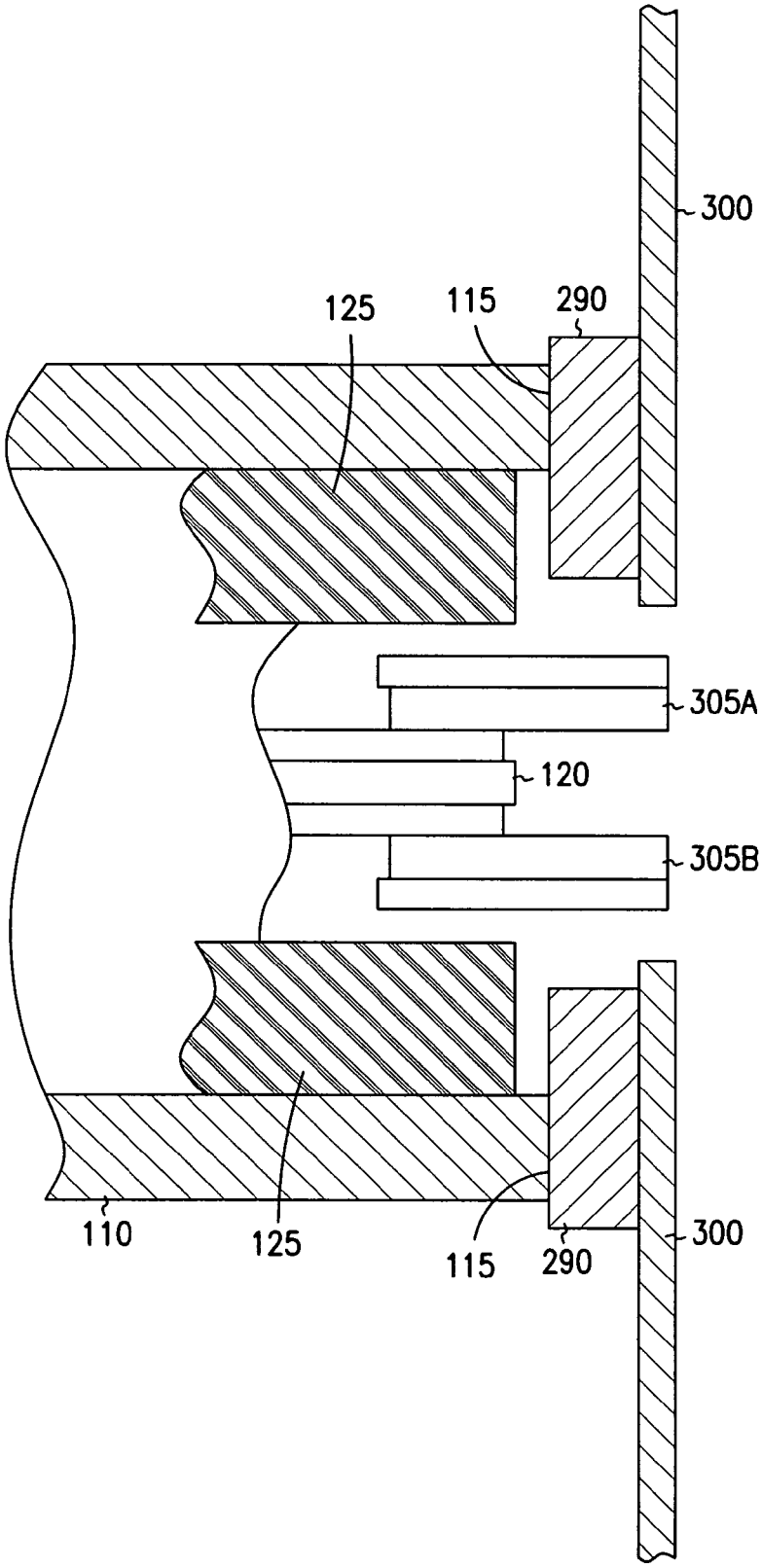
FIG. 1B illustrates a view of the present system when assembled to a matching connector.

FIG. 1B depicts a view of the present system when mated to a matching MICROPAX® connector. The matching connector is represented by items 305A and 305B, shown herein associated with electrical housing 300. Housing 300 is electrically conductive. Gasket 290 is positioned between mating face 115 of connector housing 110 and housing 300. Gasket 290 includes a center opening to allow coupling of connector 120 with matching connectors 305A and 305B. Gasket 290 attenuates EMI radiation and provides a low impedance electrical connection between housing 110 and housing 300. In the figure, insulative shell holder 125 is encased by electrically conductive housing 110. As shown, connector 120 mates with matching connectors 305A and 305B.

In one embodiment, proper assembly of the connector 120 to matching connector 305A and 305B includes engagement of a jackscrew (not visible in the figure). Gasket 290 is compressed by the force exerted by the jackscrew. Compression of gasket 290 reduces the impedance between face 115 and housing 300. Compression also increases EMI attenuation at the interface of face 115 and housing 300.

Figure 2:
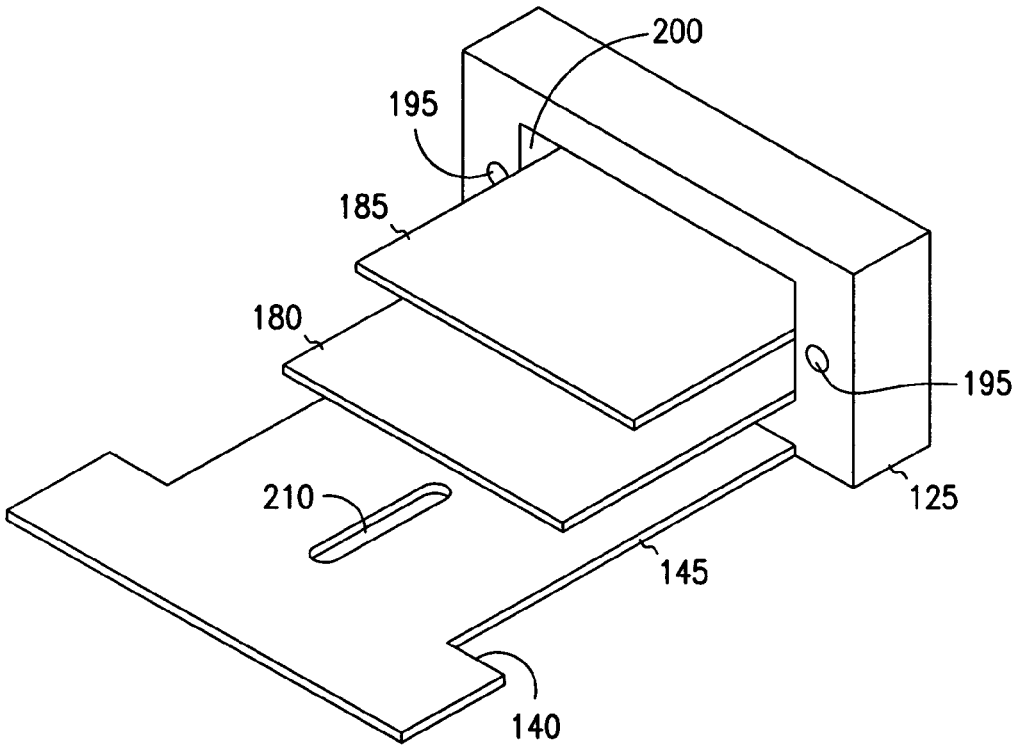
FIG. 2 illustrates an isometric view of a portion of one embodiment of the present system.

FIG. 2 depicts an isometric view of a portion of one embodiment of the present system. In the embodiment shown, shell holder 125 is affixed to shell holder base 145. Shell holder 125 includes holes 195 on either side of paddleboards 180 and 185. Hole 195 receives a jackscrew. In addition, a spring (not shown in this figure) exerts a force on the rearward face of shell holder 125.

Paddleboards 180 and 185 receive conductors of the cable and provide an interface with connector 120. Paddleboard 185 is shown herein as having a length less than paddleboard 180, however the present system is not so limited and the relative lengths can be otherwise. In one embodiment, the cable includes copper conductors, each of which is bonded to conductors of paddleboard 180 or 185. In one embodiment, bonding includes soldering conductors to the connector.

Cavity 200 receives paddleboards 180 and 185 and connector 120. Cavity 200 is shown herein as a rectangular hole in shell holder 125, however, other configurations are also contemplated.

As noted above, shell holder 125 is fabricated of insulative material. In one embodiment, shell holder 125 is fabricated of a material selected for having properties that reduces capacitive coupling between the connector and the backshell housing.

Base 145 includes cars 140. Ears 140 maintain alignment of shell holder 125 within housing 110. Shell holder base 145 also is shown herein having slot 210 aligned substantially parallel with the direction of movement of shell holder 125. Slot 210 maintains alignment of shell holder 125 and provides mechanical limits to the travel of shell holder 125.

Figure 3:
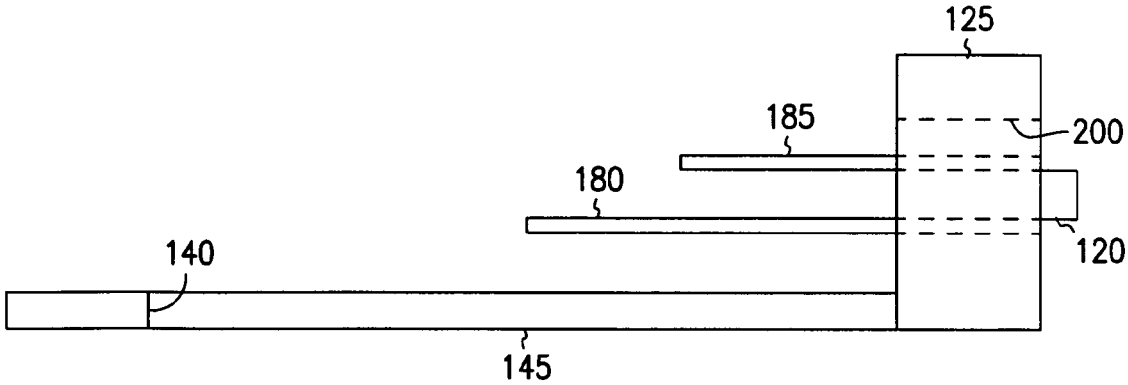
FIG. 3 illustrates a side view of the portion shown in FIG. 2.

FIG. 3 depicts another view of one embodiment of connector 120, shell holder 125, paddleboard 180, paddleboard 185, and shell holder base 145. The boundaries of cavity 200 are visible as a hidden line within shell holder 125. Ear 140 appears on the rearward portion of base 145. In the embodiment shown, paddleboards 180 and 185 extend forward through shell holder 125 and are integral with connector 120.

Figure 4:
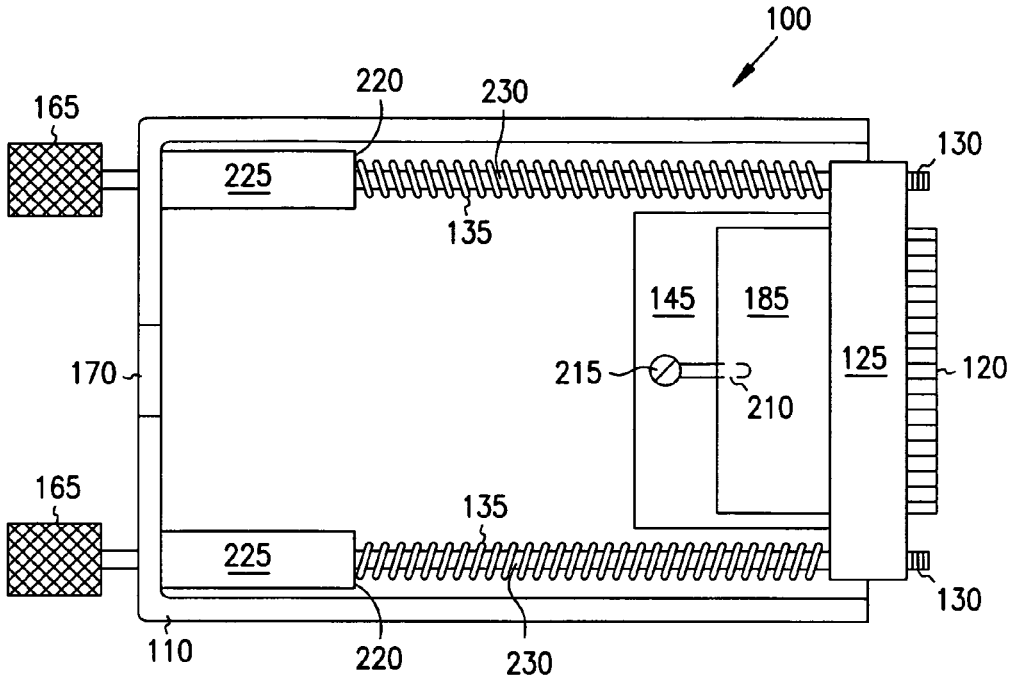
FIG. 4 illustrates a top view of an embodiment of the present system.

FIG. 4 depicts a view of another embodiment of present system 100. In the embodiment shown, electrically conductive housing 110 provides a housing for connector 120 and various associated components. An electrical cable enters the housing at orifice 170 and terminates at the connector 120. Electrical connection to the connector 120, in the embodiment shown, is established by means of a pair of paddleboards. Paddleboard 185 is visible in the figure and a second paddleboard is obscured by the first. Shell holder base 145 is coupled to shell holder 125 (with connector 120) and moves fore and aft as limited by slot 210 and screw 215. Spring 135 exerts a forward force on shell holder 125. A first end of spring 135 is in contact with shell holder 125 and a second end of spring 135 is in contact with standoff 225. Standoff 225 is in contact with an interior wall of housing 110 and spring 135 at face 220. Spring 135, and standoff 225 are concentrically aligned with jackscrew 230. Jackscrew 230 includes head 165 for manual manipulation of jackscrew 230. Head 165 also contacts housing 110 and exerts a clamping force to secure face 115 of housing 110 to an electrical housing associated with a matching connector.

Figure 5:
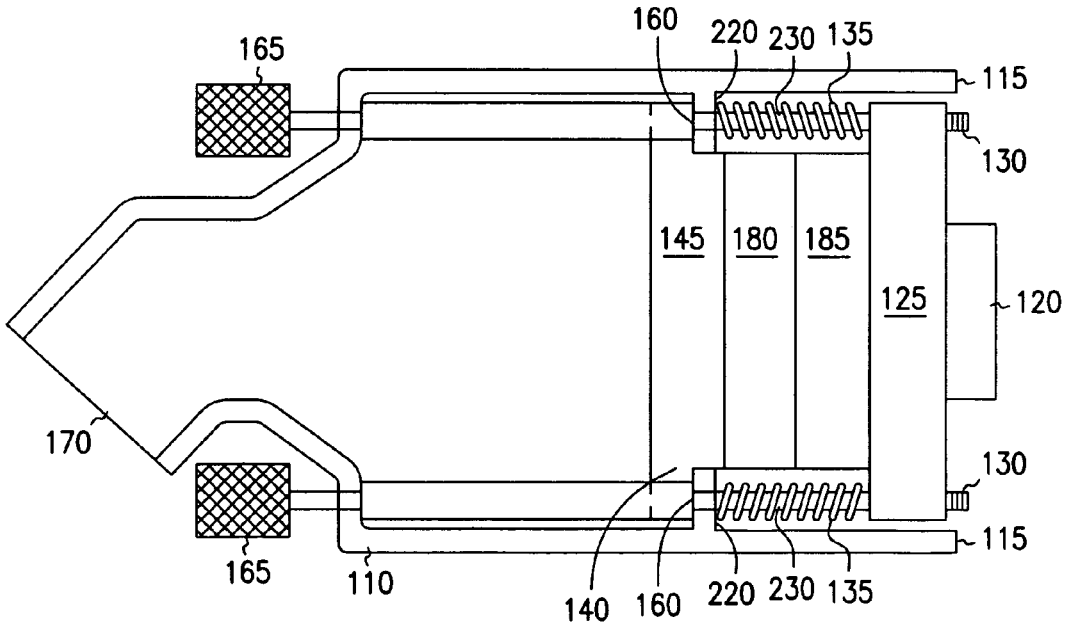
FIG. 5 illustrates a top view of an embodiment of the present system.

FIG. 5 illustrates another embodiment of the present system. Housing 110 includes mating face 115 at a forward end and cable orifice 170 at a rearward end. Connector shell 120 extends forward of shell holder 125. Electrical connections to electrical connector 120 are via paddleboard 185 and paddleboard 180. Shell holder base 145 extends rearward from shell holder 125 into housing 110. Base 145, in the embodiment shown, includes ears 140 that slidably engage structure 220 of housing 110 to limit the forward movement of shell holder 125 and connector 120. Ears 140 also help maintain alignment of shell holder 125 in housing 110.

Spring 135 is held captive on the shaft of jackscrew 230 and exerts an opposing force on shell holder 125 and housing structure 220. Engagement of thread end 130 of jackscrew 230 results in a clamping force applied to housing 110 at shoulder 160. Face 115 is forced against the gasket 290 by jackscrew 230.

In the embodiment shown in FIG. 5, the cable exits housing 110 at an angle relative to the longitudinal axis. The longitudinal axis is parallel with the direction of travel of connector 120. In other embodiments, the cable exits the housing at an angle substantially parallel with the longitudinal axis.

Figure 6B:
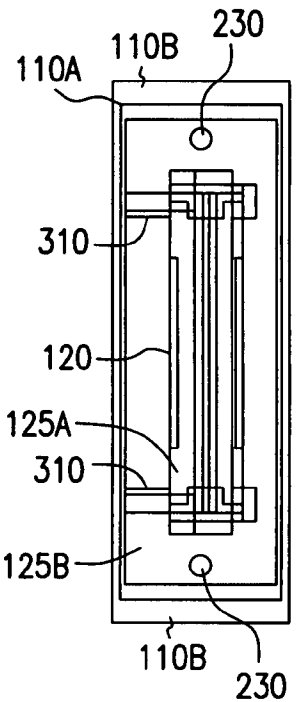
FIGS. 6A and 6B illustrate a top view and an end view, respectively, of an embodiment of the present system.
Figure 6A:
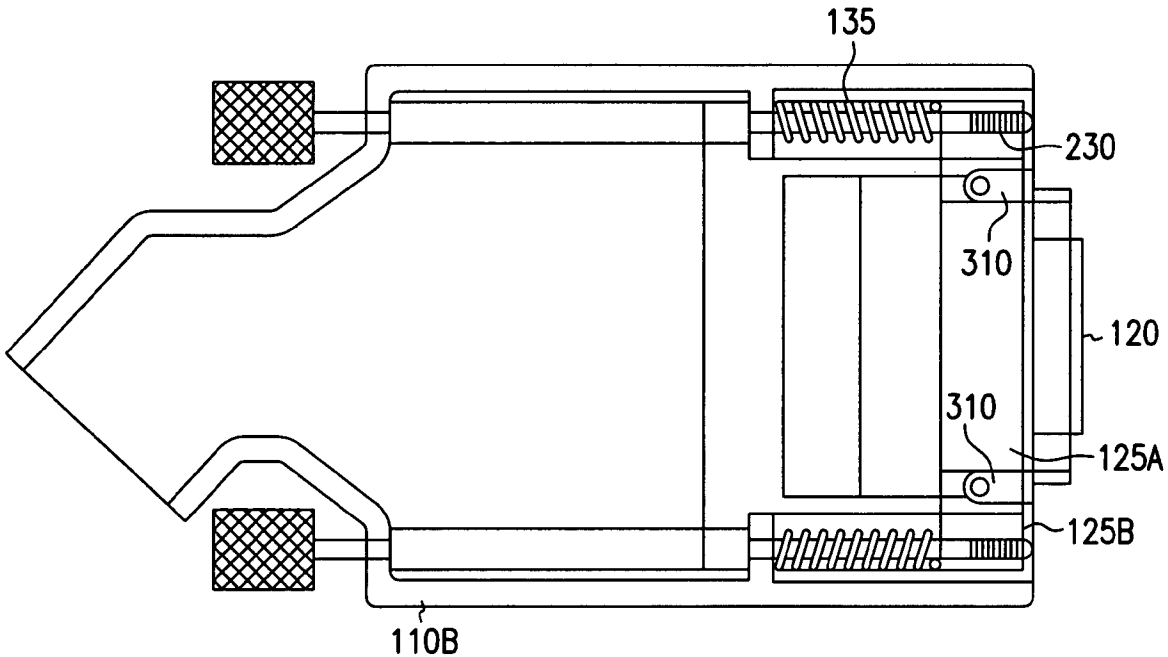
Figure 6C:
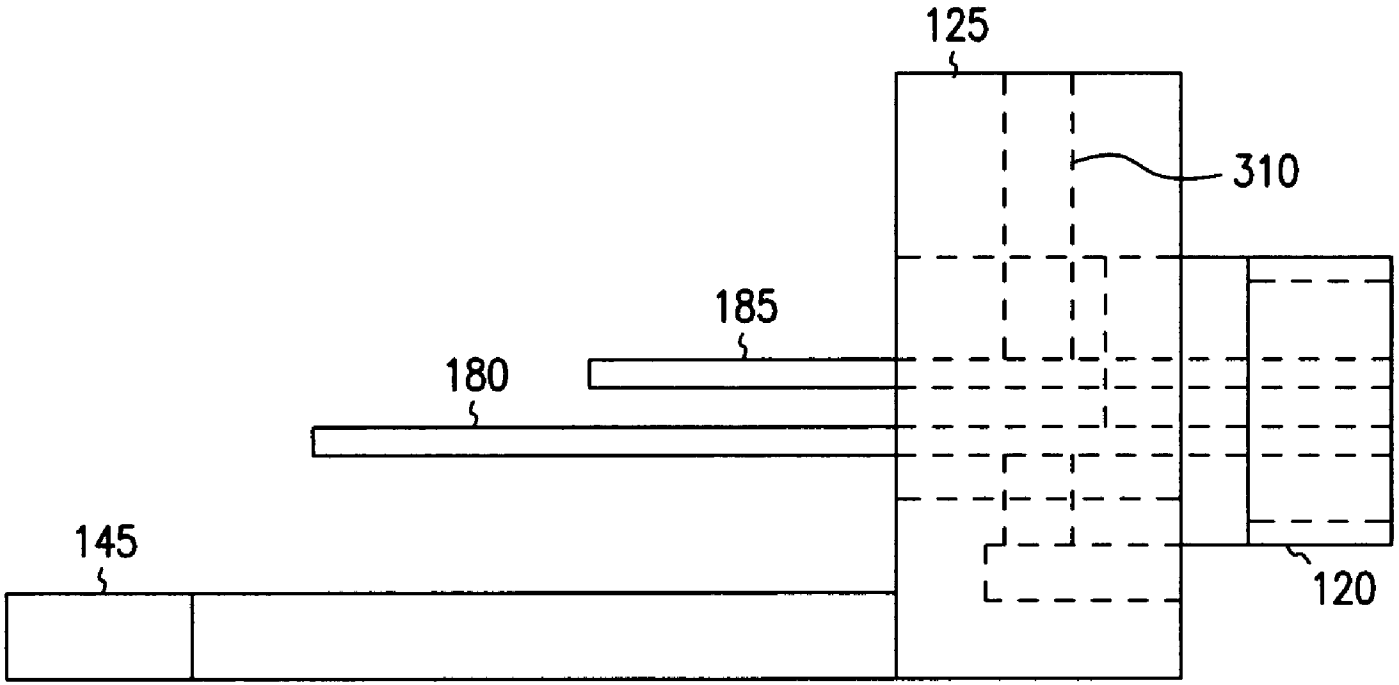
FIG. 6C illustrates a side view of a portion of one embodiment of the present system.

FIGS. 6A, B and C illustrate another embodiment of the system of FIG. 5. In the figures, connector housing 110B includes a metal housing having walls and a bottom surface. Housing connector lid 110A is fastened to housing 110B. Lid 110A is fastened to housing 110B by means of threaded fasteners, rivets, drive screws or other means.

In the embodiment shown, shell holder 125 is depicted as a two-part assembly including shell holder 125A and shell holder 125B. Shell holder 125B includes a cavity shaped to receive connector 120, herein depicted as including the MICROPAX® shell. Shell holder 125A includes a cover plate to secure shell 120 within holder 125B. Shell holder 125A and shell holder 125B each include two holes 310 for accepting threaded fasteners. In one embodiment, connector 120 is sandwiched between shell holder 125A and 125B using two machine screws and two nuts.

FIG. 7 illustrates another embodiment of the present system. FIG. 7A shows a connector housing lid 110A having cable orifice 170 and mating face 115. Lid 110A is of cast aluminum construction having raised webs, or ridges as indicated at items 320 and thickened sections as indicated at 325. In addition to providing structural reinforcement and strength, the ridges and thickened sections, in conjunction with the walls of housing 110B (FIG. 7B), provide an improved EMI seal. Also visible in FIG. 7A are cable sealing members 330. Cable sealing members 330 are further described with respect to FIG. 9 and are captivated by the webs and thickened sections of lid 110A.

Figure 7C:
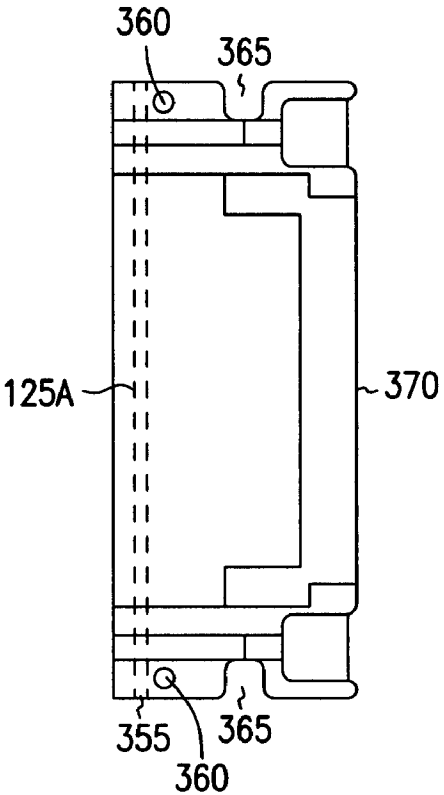
FIGS. 7A, 7B, 7C and 7D illustrate portions of one embodiment of the present system.
Figure 7A:
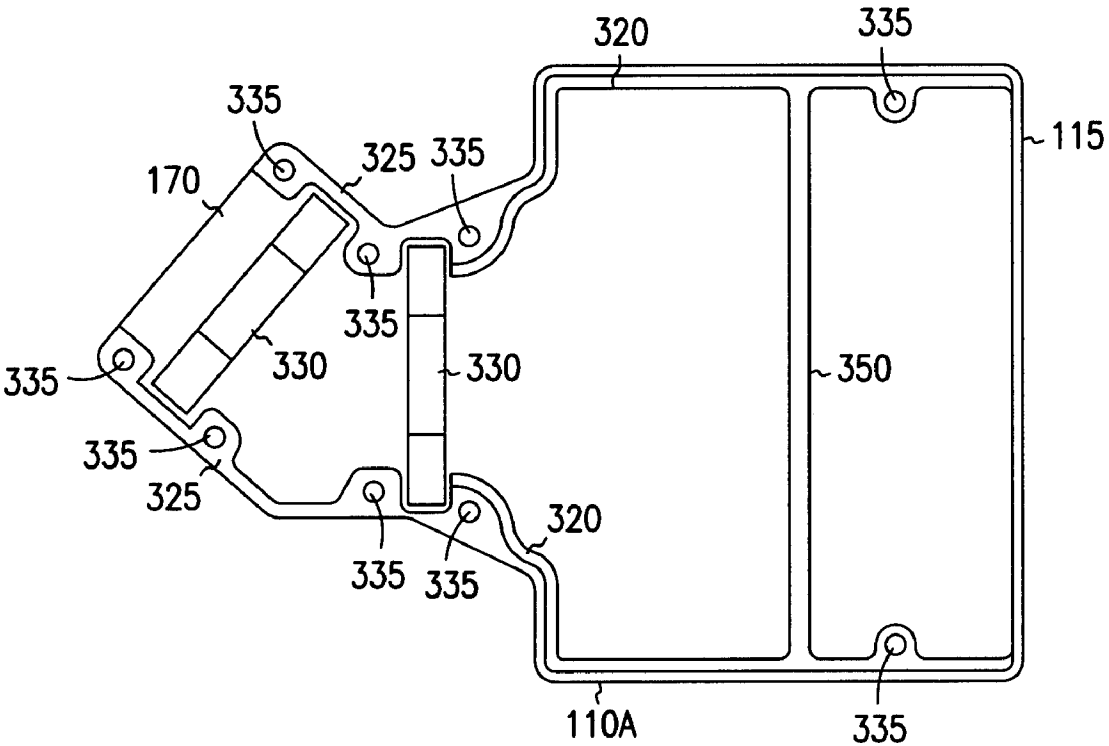
Figure 7D:
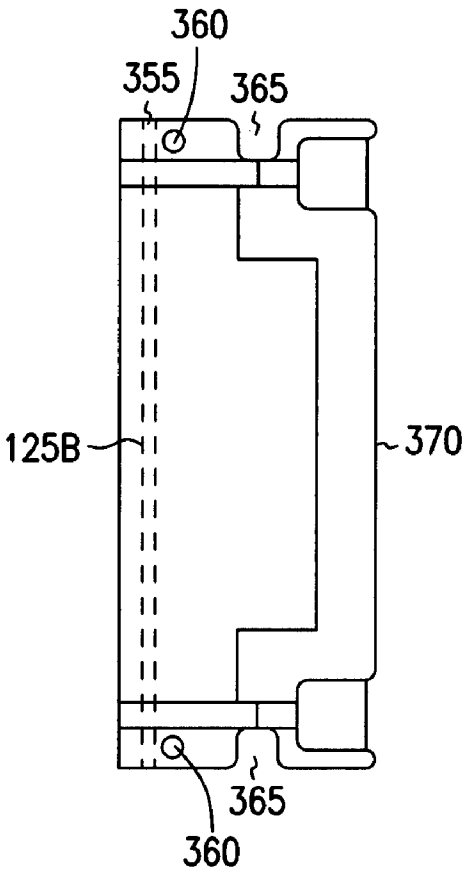
Figure 7B:
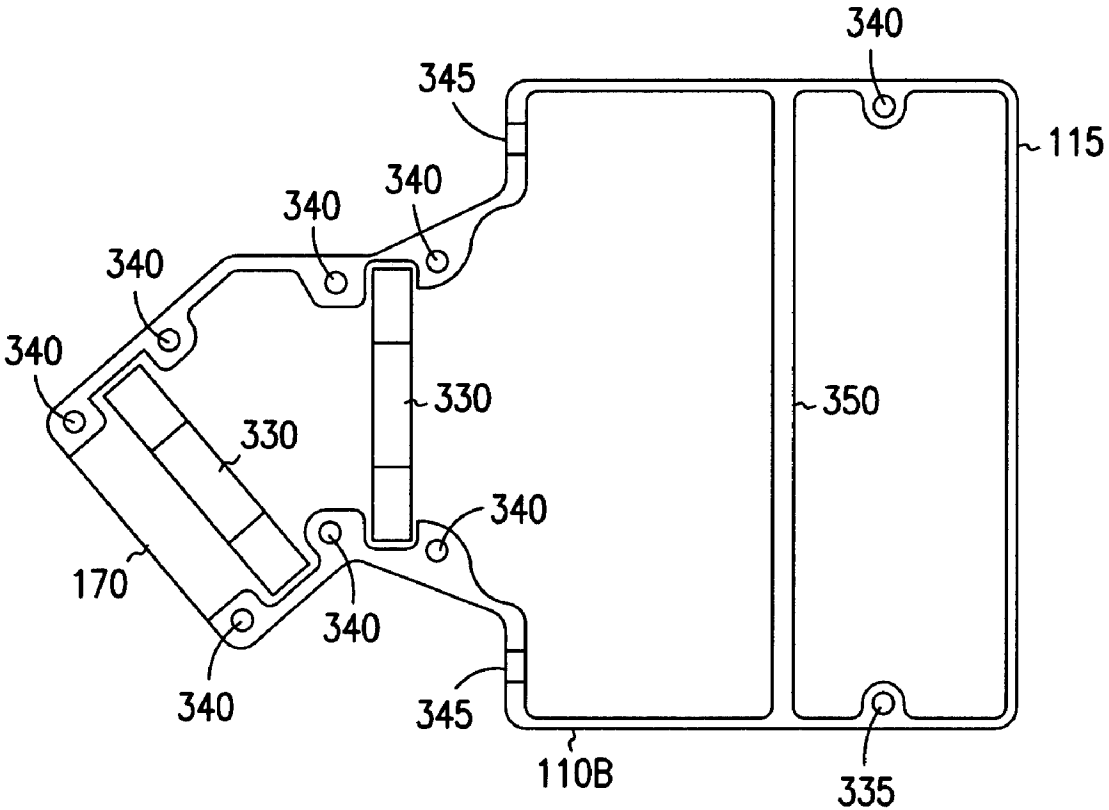
Figure 8A:
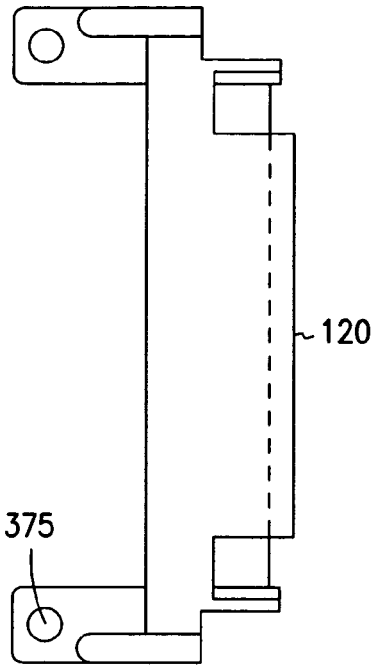
FIGS. 8A, 8B, 8C and 8D illustrate different views of a connector shell suitable for use with the present system.
Figure 8D:
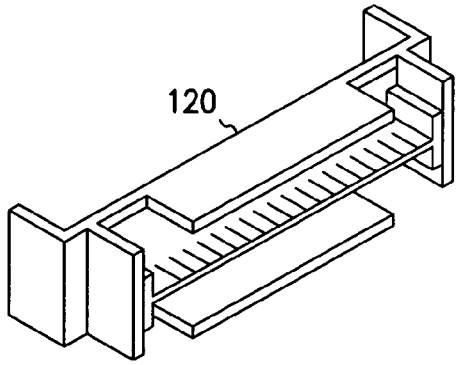
Figure 8B:
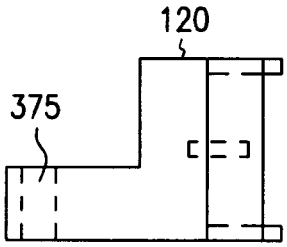
Figure 8C:
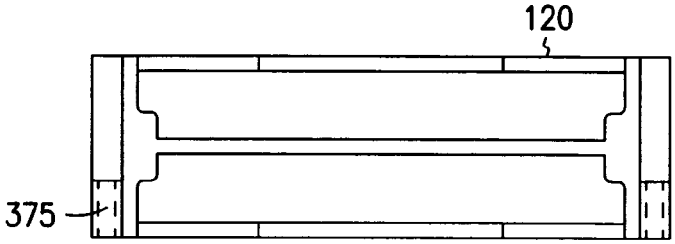

FIG. 7B illustrates housing 110B having cable orifice 170 and mating face 115. Housing 110B has wall sections including a plurality of threaded holes 340 for attachment of lid 110A using machine screws. Holes 345 are clearance holes for the shaft of jackscrew 230. Cable sealing members 330 are captivated by the walls of housing 110B.

In both FIG. 7A and FIG. 7B, ridge 350 is aligned transverse with respect to the longitudinal axis. Ridge 350 provides reinforcement and prevents substantial movement of the connector 120. Connector 120, and shell holder 125A and 125B are held securely relative to lid 110A and housing 110B.

Connector shell holder sections 125A and 125B are illustrated in FIGS. 7C and 7D, respectively. Sections 125A and 125B are adapted to fit within lid 110A and housing 110B, respectively. Alignment groove 355, visible as hidden lines in each of sections 125A and 125B, mates with ridge 350 in lid 110A and housing 110B. Holes 360 accept mechanical fasteners for securing connector 120 in the assembled shell holder sections 125A and 125B. Shell holder sections 125A and 125B are adapted to accept connector 120 in recess 370. Clearance for the wall section near the two forward holes 340 in housing 110B and lid 110A are provided by notches 365.

FIG. 8 illustrates one embodiment of connector 120, including a shell, suitable for use with the present system. FIGS. 8A, 8B and 8C depict top view, end view and forward view, respectively of connector shell 120. FIG. 8D depicts an isometric view of connector shell 120. Shell 120 includes a pair of mounting holes 375 for securing connector shell 120 to shell holder 125. In one embodiment, connector shell 120 is fabricated of cast, or machined, metal. In one embodiment, connector shell 120 is available from Berg Technology, Inc., One East First Street Reno, Nev. 89501 and is known in the trade as a MICROPAX® connector shell.

Figure 9A:
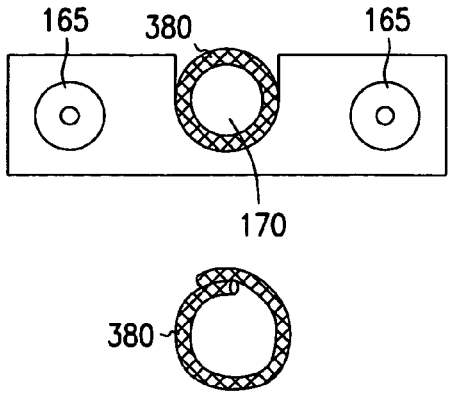
FIGS. 9A, 9B and 9C illustrate various electromagnetic interference bonding mechanisms for cable shielding.
Figure 9B:
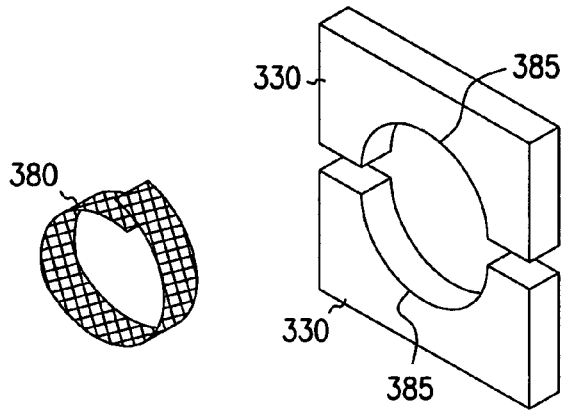
Figure 9C:
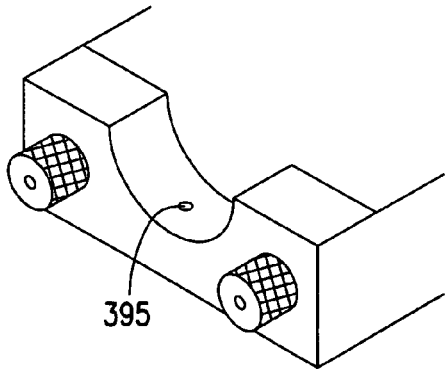

FIG. 9 illustrates alternative cable sealing means. FIG. 9A provides a forward view of the backshell assembly, as viewed from the rear. Visible in the figure are jackscrew heads 165. Also visible is cable orifice 170. In one embodiment, housing 110 includes a sealing surface 395. In the embodiment shown, the sealing surface 395 is lined with cable sealing, or packing material 380. Cable packing material 380 may be a woven or non-woven conductive metal material in the form of a coiled strip. A rivet may be used to secure the cable packing material 380 to sealing surface 395.

In FIG. 9B, cable sealing members 330 are illustrated, each having semicircle 385. Sealing members 330 are fabricated of conductive metal and are adapted to fit securely in the webs and thickened sections of lid 110A and housing 110B of FIGS. 7A and 7B, respectively. Sealing material 380 is a woven or non-woven conductive metal material in the form of a coiled strip.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention.

What is claimed is:

1. A method of manufacturing a connector, the method comprising:

providing a conductive housing, the housing having a nose and a terminating end and further including an interior;

providing an electrical connector, the connector having a plurality of conductive members and encased in a conductive jacket;

providing an insulative jacket surrounding the conductive jacket of the electrical connector, the insulative jacket rigidly secured to the electrical connector;

engaging the electrical connector with a linear way of the interior, the linear way disposed along an axis between the nose and the terminating end;

applying a mechanical force to urge movement of the electrical connector in a direction towards the nose; and providing a mechanical fastener to enable coupling the housing to a matching connector.

2. The method of claim 1 further comprising assembling a cable to the electrical connector.

3. The method of claim 1 further comprising coupling the connector with the housing.

4. The method of claim 1 further comprising assembling a lid to the conductive housing.

5. A method comprising:

encasing an electrical connector with an insulative sleeve;

engaging the insulated electrical connector with a linear way disposed in an interior of a conductive housing;

applying a force to urge the electrical connector towards a first end of the linear way; and providing a clamping assembly to mechanically urge the conductive housing in a direction aligned with the linear way.

6. The method of claim 5 wherein engaging the insulated electrical connector with the linear way includes engaging the insulated electrical connector on a shaft.

7. The method of claim 5 wherein engaging the insulated electrical connector with the linear way includes engaging the insulated electrical connector on a threaded fastener.

8. The method of claim 5 wherein applying the force includes applying a spring tension force.

9. The method of claim 5 further comprising providing a stop to prevent ejecting the electrical connector from the conductive housing.

10. A method comprising:

applying a force to urge an electrical connector in a forward direction relative to a conductive housing, the electrical connector carried substantially internal to the conductive housing and the electrical connector adapted for independent movement relative to the conductive housing;

engaging the electrical connecter with a matching connector; and clamping a mating surface of the conductive housing to an electrical circuit housing associated with the matching connector.

11. The method of claim 10 wherein applying the force includes applying a tension spring force.

12. The method of claim 10 further comprising electrically connecting the conductive housing to a cable coupled to the electrical connector.

13. The method of claim 10 wherein clamping includes rotating a threaded fastener.

14. The method of claim 10 wherein clamping includes applying a compressive force on the conductive housing.

15. The method of claim 10 wherein clamping the mating surface of the conductive housing to an electrical circuit housing associated with the matching connector includes establishing a low impedance electrical connection between the conductive housing and the electrical circuit housing.

16. The method of claim 10 further comprising encasing the electrical connector in an insulative jacket.

17. A method comprising:

providing an insulative sleeve and an electrical connector, the insulative sleeve disposed around the electrical connector;

providing a conductive housing having an interior and a mating surface, the interior adapted to accept the insulative sleeve and the electrical connector and allow movement of the insulative sleeve and the electrical connector relative to the conductive housing; and positioning a spring to urge the insulative sleeve and the electrical connector in a direction towards the mating surface.

18. The method of claim 17 further including connecting the electrical connector to a cable.

19. The method of claim 18 further comprising connecting the conductive housing to a shield conductor of the cable.

20. The method of claim 17 further comprising engaging the insulative sleeve with a linear way of the conductive housing.

21. The method of claim 17 wherein positioning the spring includes applying a tension force between the insulative sleeve and the conductive housing.

* * * * *